US005473525A

United States Patent [19]

Stout

[11] Patent Number: 5,473,525

[45] Date of Patent: Dec. 5, 1995

[54] DISCREET DISPLAY LAMP

[76] Inventor: Gary F. Stout, 127 First Ave. #13, Salt Lake City, Utah 84103

[21] Appl. No.: 21,566

[22] Filed: Feb. 24, 1993

[51] Int. Cl.[6] ..... F21S 1/12

[52] U.S. Cl. ..... 362/412; 362/140; 362/234; 362/243; 40/219; 40/554; 40/900

[58] Field of Search ..... 362/140, 234, 362/243, 245, 247, 248, 251, 411, 412, 351, 125; 40/442, 219, 554, 900

[56] References Cited

U.S. PATENT DOCUMENTS

| | | | |
|---|---|---|---|
| 2,247,545 | 7/1941 | Deck et al. | 40/219 |
| 3,025,392 | 3/1962 | Worth | 362/412 X |
| 3,937,948 | 2/1976 | Allison | 362/300 |
| 4,695,929 | 9/1987 | Smith | 362/140 |
| 4,747,223 | 5/1988 | Borda | 40/900 X |

FOREIGN PATENT DOCUMENTS

| | | | |
|---|---|---|---|
| 525482 | 8/1940 | United Kingdom | 362/412 |

*Primary Examiner*—Stephen F. Husar
*Attorney, Agent, or Firm*—Robert R. Mallinckrodt

[57] ABSTRACT

A combination table top lamp, with a base comprised of a material that appears opaque until the inside of the base is illuminated, at which time the base appears transparent to reveal a display item in the base. A scrim can be incorporated into the surface of the base such that the scrim becomes part of the display when the material used for the base is transformed.

1 Claim, 1 Drawing Sheet

DISCREET DISPLAY LAMP

BACKGROUND OF THE INVENTION

1. Field of the Invention

The present invention relates in general to display devices, and in particular to a combination table lamp wherein the display items are selectively hidden or revealed.

2. Description of the Prior Art

Heretofore, a number of lamp assemblies have been proposed having display features for displaying various items. Examples of these previously proposed lamp assemblies are disclosed in the following U.S. patents:

| U.S. Pat. No. | PATENTEE |
|---|---|
| 1,721,176 | Campo |
| 1,762,634 | Jyumi |
| 2,125,358 | Renholdt |
| 2,945,948 | Maffei |
| 3,819,924 | Thomas |
| 4,028,848 | Murray |
| 4,509,105 | Short |
| 4,626,972 | Wolf |

The Campo U.S. Pat. No. 1,721,1 76 discloses a lamp having a base with a low voltage lamp therein to give a low level of illumination for use as a night light. No distinct display is provided.

The Jyumi U.S. Pat. No. 1,762,634 discloses a fish bowl and lamp combination where the base portion of the lamp includes a fish bowl with water and fish therein.

The Renholdt U.S. Pat. No. 2,125,358 discloses a lamp comprising a lower part including a semi-spherical hollow shell and an upper part or dome which is made of a transparent material such as clear or tinted glass. Within the dome is a platform having an ornament mounted thereon such as a model sailboat. The dome is always transparent.

The Maffei U.S. Pat. No. 2,945,948 discloses a lamp wherein a lamp cord is concealed inside of a hollow tube within the base portion of the lamp assembly. The other contents of the base are never concealed.

The Thomas U.S. Pat. No. 3,819,924 discloses a cone shaped lamp wherein items may be affixed to, or placed on annular shelves of the exterior surface of the casing, to be illuminated when the lamp is energized. The display items are visible when the lamp is not energized.

The Murray U.S. Pat. No. 4,028,848 discloses a lamp with a lower portion comprising a transparent pear-shaped terrarium bowl. The casing of the lower portion is never opaque.

The Short U.S. Pat. No. 4,509,105 discloses a lamp assembly comprising a modular base portion in which display articles may be mounted. Such articles are not separately illuminated and are visible when the lamp is not activated.

The Wolf U.S. Pat. No. 4,626,972 discloses a lamp having a base, with a low wattage bulb therein to illuminate the base and illuminate three dimensional pictures mounted on the sides of the base. The pictures are not concealed when the interior of the base is not lighted.

Such prior art combination lamps have not provided means for selectively concealing or revealing the display item or scene contained therein.

None of the patents show or suggest the use of a material for a lamp base with changing optical properties.

SUMMARY OF THE INVENTION

It is a principal object of the present invention to provide a display device, wherein the optical properties of the casing change such that the display articles are not visible until the device is activated, at which time the display items are revealed.

In accordance with the present invention, there is provided a combination lamp comprising a two-way transmissive medium used for the base that appears opaque until activated at which time it appears transparent to reveal a scene on the surface of, and/or a display item in the base. The change in the appearance of the lamp base is caused by changing the relative illumination of a two-way mirror type material by energizing a light source inside of the lamp base.

DESCRIPTION OF THE PREFERRED EMBODIMENT

Figure 1:
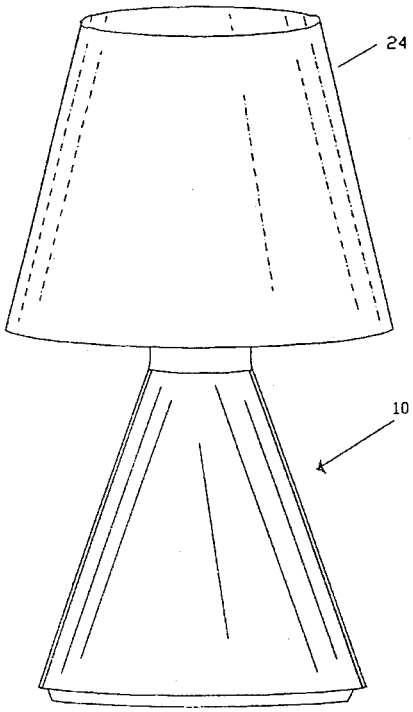
FIG. 1 is a perspective view of a combination lamp assembly constructed according to the teachings of the present invention.
Figure 2:
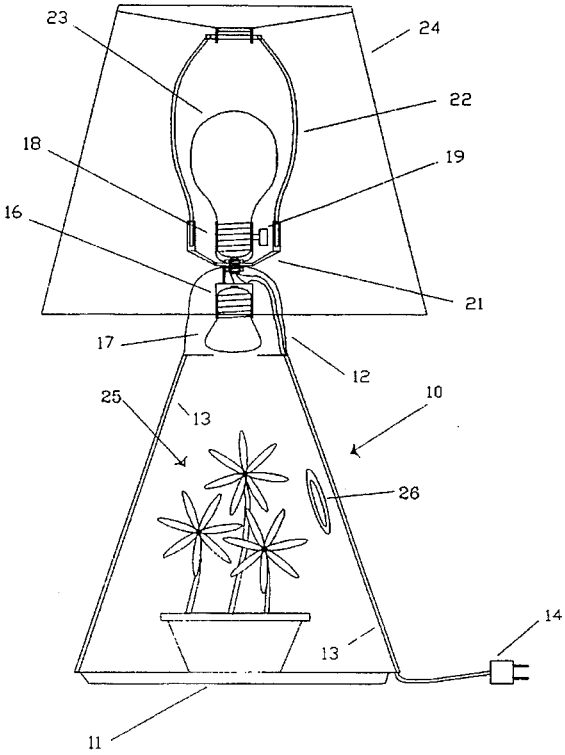
FIG. 2 is a vertical cross-sectional view taken through the center of the lamp.

Referring now to the FIG. 1 and the FIG. 2, a combination lamp assembly constructed according to the teachings of the present invention is shown therein. The lamp assembly includes the display article(s) 25 inside of, and/or the scrim display 26 affixed to the surface of a novel base portion 10 comprising a casing of varying optical appearance 13 removably mounted to a base plate 11 and to a vented base cap 12. The display article(s) 25 are enclosed inside of a cone-shaped casing 13 formed from a flat sheet of two-way transmissive material.

The socket 18 is a type of three-way socket that when properly interconnected with the socket 16 will energize either one, or both of the lamps 17 and 23 upon operation of the knob 19. The base cap 12 includes a ceramic socket 16 and an electric light bulb 17 for illuminating the interior of, and causing the change in the appearance of the casing 13 when the knob 19 of the three-way socket 18 is operated. A conventional framework comprising a cradle piece 21 and a harp piece 22 extends about and above the bulb 23 to support a lamp shade 24.

Figure 3:
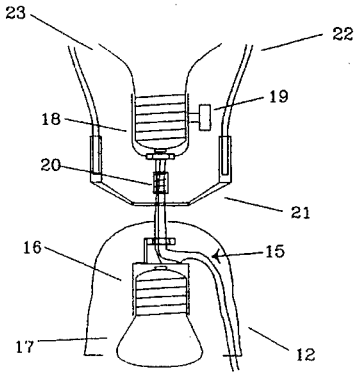
FIG. 3 is a fragmentary exploded view of an enlarged scale, showing a detail of construction.

Referring now to FIG. 3. Sockets 16 and 18 are secured by a threaded metal cylinder 20, which extends through the base cap 12 and the framework piece 21. Sockets 16 and 18 are connected with the wires 14 and 15 in a manner that will cause either bulb 17 or 23 or both to energize when a switch inside of the three-way socket 18 is operated by the knob 19. Lamp cord 14 is routed along the interior seam of the casing 13 to reduce visibility.

It is believed that the invention operates as follows:

Assuming that initially the lamp 17 is off, and the lamp 23 is on, the relative illumination causes the casing 13 to appear as a curved mirror surface, thus concealing the display article(s) 25.

Rotation of the knob 19 will first cause the lamp 17 to go on, and the lamp 23 to go off. With the lamp 17 on, the interior of the lamp base 10 will illuminate changing the relative illumination of, and causing the casing 13 to appear transparent, thus revealing and illuminating the display article(s) 25 and the scrim 26.

Further rotation of the knob 19 will cause the lamp 17 to go off, with both of the lights off, the casing of the lamp base 10 appears opaque.

Further rotation of the knob 19 will cause both of the lamps 17 and 23 to light, with the lamp 17 on, the interior of the lamp base 10 will illuminate changing the relative illumination of, and causing the casing 13 to appear transparent, thus revealing and illuminating the display article(s) 25 and the scrim 26.

Further rotation of the knob 19 will again cause the compound lamp to return to the initial condition with the lamp 17 off, and the lamp 23 on. The lamp will then appear as a lighted conventional table-top lamp with a mirror base.

Figure 4:
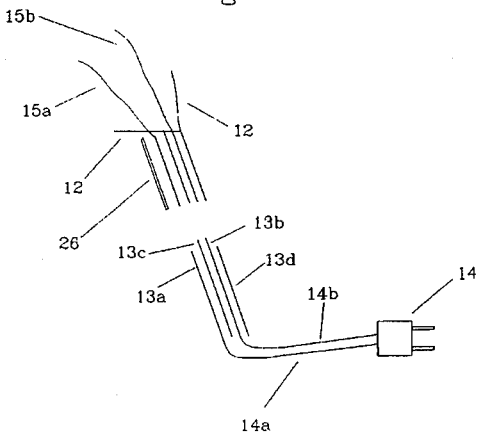
FIG. 4 is a vertical cross-sectional view of a multi-layered conductive two-way mirror material.

Refer now to FIG. 1 and FIG. 2, which is an overall drawing of a preferred embodiment of the invention. Variations of the invention include the following:

Referring now to FIG. 4, there is shown in greater detail a means for invisibly conducting the required electricity through the casing 13. Conductive mirror layer 13*a* is connected to the wire 14*a* and the wire 15*a*. Conductive mirror layer 13*b* is connected to the wire 14*b* and the wire 15*b*. Layer 13*c* is an insulating layer placed between the conductive layers 13*a* and 13*b*. A scrim decal 26 may be placed near, or contained within said non-visible conductive means which may be directly applied to a seamless outer envelope 13*d* of any shape or size. All, part, or none of the scrim 26 may be visible prior to the optically changing medium 13 being transformed.

The means for changing the optical properties, which include the color, refraction, reflection, diffusion, fluorescence, emission, translucence, and transmission, of the casing include comprising it of materials that will respond directly or indirectly to electrical stimulus, or changes in temperature, or other external influences.

The foregoing description of the preferred embodiment of the invention has been presented for the purpose of illustration and description. It is not intended to be exhaustive or to limit the invention to the precise form disclosed. Many modifications and variations are possible in light of the above teachings. It is intended that the scope of the invention be limited not by this detailed description, but rather by the claims appended hereto.

I claim:

1. A table lamp comprising: a first light source mounted to the top of a hollow lamp base, a second light source located within said hollow lamp base, and one or more display articles located within and surrounded by said hollow lamp base, wherein said hollow lamp base is comprised of a material whose optical properties render said hollow lamp base opaque when exposed to ambient light or said first light source and when said hollow lamp base is illuminated internally by said second light source the optical properties of said hollow lamp base material render said hollow lamp base transparent and thereby reveal said one or more display articles located within said hollow lamp base.

* * * * *